United States Patent [19]

Feldman et al.

[11] 4,209,306

[45] Jun. 24, 1980

[54] PULSED ELECTROSTATIC PRECIPITATOR

[75] Inventors: Paul L. Feldman, Bridgewater; Krishnaswamy Sampathkumar, Somerville, both of N.J.

[73] Assignee: Research-Cottrell, Somerville, N.J.

[21] Appl. No.: 959,987

[22] Filed: Nov. 13, 1978

[51] Int. Cl.[2] ..... B03C 3/02

[52] U.S. Cl. ..... 55/2; 55/139; 55/151

[58] Field of Search ..... 55/2, 139, 136, 151-154

[56] References Cited

U.S. PATENT DOCUMENTS

| | | | |
|---|---|---|---|
| 3,026,964 | 3/1962 | Feldman | 55/137 |
| 3,511,030 | 5/1970 | Hall et al. | 55/139 |
| 3,915,672 | 10/1975 | Penney | 55/2 |
| 3,980,455 | 9/1976 | Masuda | 55/139 |
| 3,981,695 | 9/1976 | Fuchs | 55/2 |
| 4,133,649 | 1/1979 | Milde | 55/2 |
| 4,138,233 | 2/1979 | Masuda | 55/139 |

FOREIGN PATENT DOCUMENTS

| | | | |
|---|---|---|---|
| 2130805 | 12/1972 | Fed. Rep. of Germany | 55/2 |

OTHER PUBLICATIONS

White—Ind. Electrostatic Ppt'n Addison Wesley Publishing Co., Apr. 1969, pp. 212, 363.

*Primary Examiner*—Bernard Nozick
*Attorney, Agent, or Firm*—Paul & Paul

[57] ABSTRACT

Parameters for optimum operation of a pulsed multisection electrostatic precipitator are disclosed: It has been discovered that superior particulate collection can be achieved by a combination of pulse and conventional DC voltages. The pulse rise time and decay time are made short enough so that adverse sparking conditions do not develop. The base voltage (conventional DC voltage) is adjusted in coordination with the superposed pulse characteristics (pulse voltage, pulse frequency and pulse shape) to maintain an average current through the collected dust layer just below or at that value which would cause electrical breakdown of the dust layer. Base voltage may actually be below normal corona starting voltage in some cases. The pulse produces instanteously very high ion densities and electric field strengths. In one design of precipitator, alternate sections are pulsed, with the other alternate sections functioning as collecting sections and merely having DC base voltage applied thereto. In other designs, all sections including the collecting sections, may be pulsed to provide sufficient current to hold the collected particles on the collecting surfaces and to prevent reentrainment. In some designs, at least one of the sections may be a transmission line which is pulsed.

4 Claims, 3 Drawing Figures

PULSED ELECTROSTATIC PRECIPITATOR

BACKGROUND OF THE INVENTION

This invention relates to electrostatic precipitators.

In conventional precipitators, a half-wave or full-wave transformer provides voltage to the discharge electrodes. This provides both corona charging fields and particle collecting fields. These fields are not independent and are limited to the spark breakdown voltage seen by the precipitators. For high resistivity dust collection, breakdown in the dust layer at the collecting electrodes can happen at very low voltage levels and seriously impede particle charging and collection.

The invention also relates particularly to electrostatic precipitators in which a pulse voltage is applied to the corona discharge electrodes superimposed on top of the DC base voltage.

The invention also relates to multistage precipitators in which a preceding stage may be pulsed to produce the ionization to charge the particles and a succeeding stage may be used to collect the charged particles.

SUMMARY OF THE INVENTION

The present invention is directed toward optimizing a multi-section precipitator so as to overcome the problems of handling difficult dusts and their inherently deficient particle charging and collecting fields.

It has been discovered that very high particle charging can be obtained by superposing very short pulses at very high voltage levels onto the base DC voltage without causing electrical breakdown within the precipitator. Depending on the shortness of pulsation, very high instantaneous ion densities, and possibly high electron densities, are emitted from the discharge electrodes which expand to the collecting electrode as a result of the applied underlying base voltage. By suitable adjustment of such parameters as base voltage, pulse voltage, pulse rise time, pulse width, and pulse repetition rate, very efficient particle charging at adequate particle collecting fields can be obtained.

By adjusting the pulse characteristics in combination with discharge electrode diameters and interelectrode spacing, a very high degree of freedom is obtained with respect to optimizing the charging and collecting fields.

An important feature of the present invention is the ability to vary the charging and collecting fields independently of each other. By superimposing pulse voltages over a base voltage of the same polarity, the pulse characteristics may be varied along with the base voltage, independently of each other, so that each may be adjusted to a level that results in optimum precipitator performance.

DETAILED DESCRIPTION OF THE PREFERRED EMBODIMENTS

Figure 1:
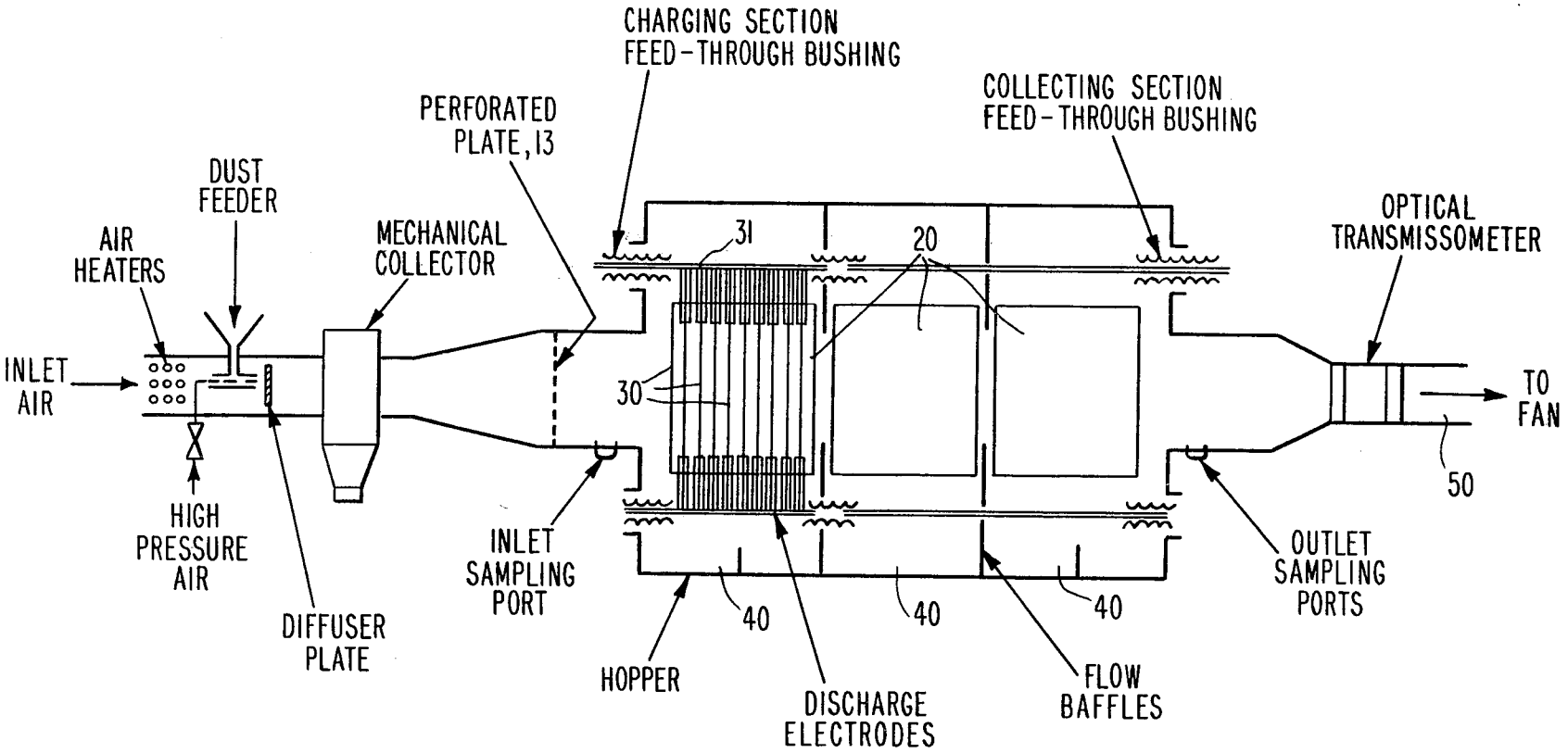
FIG. 1 is a schematic of the multi-section precipitator used in making the laboratory tests.

In FIG. 1, dust or other particulate material in a waste gas stream is fed through a perforated plate 13 prior to the inlet section of a multi-section, single duct precipitator. In FIG. 1, there are only three sections shown but preferably there are at least four sections.

In FIG. 1, each section includes a pair of opposing collecting plates 20, spaced about 9" apart. The collecting plates may be of various dimensions. Suspended between a pair of high tension bars 31, and centered between the collecting plates 20 in each section, is a set of nine discharge wire electrodes 30, each as long as the plates. These discharge electrodes are of uniform size and spacing in any one installation but may vary in different installations. In one embodiment of FIG. 1, each discharge wire electrode has a diameter of 0.109 inches and the electrodes are spaced 5¼ inches apart. In another embodiment, each discharge wire electrodes has a diameter of 0.25 inches and the electrodes spaced 3½ inches apart. The spacing from each electrode to a collecting plate is 4.5 inches.

After passing through the three or more sections of the precipitator illustrated in FIG. 1, the gas exits through the outlet duct 50. Hoppers 40 are provided in each section below the collecting plates 20 for collection of the particles collected on the plates 20.

In some modes of operation, the discharge electrodes 30 in each of the sections are pulsed. In other modes of operation, only the discharge electrodes of the inlet section are pulsed. Where only the inlet section is pulsed, the discharge electrodes of the other sections have DC base voltage applied and these sections function as collecting sections.

Figure 3:
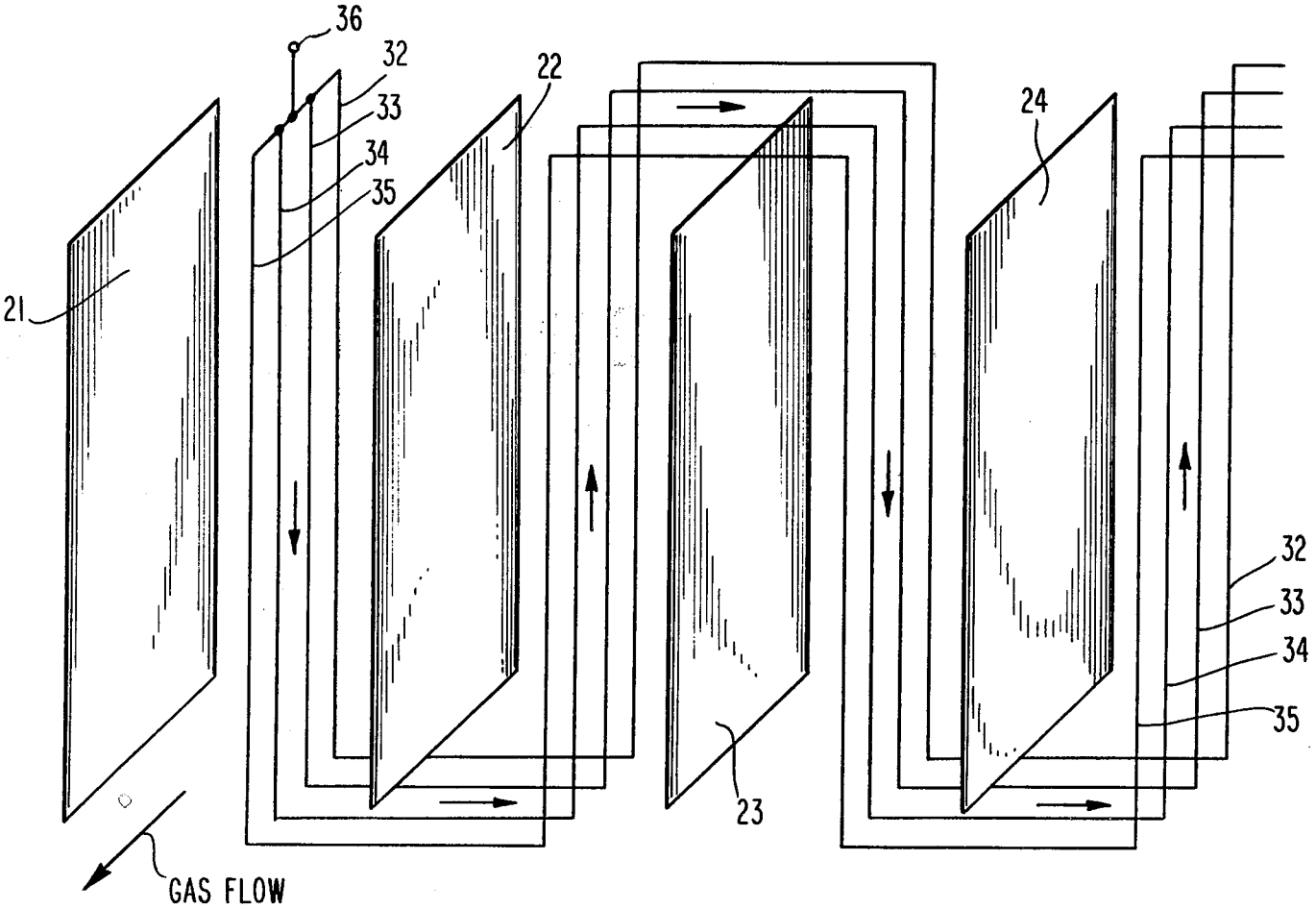
FIG. 3 is a schematic illustration of a folded transmission line which may be employed as one of the sections of the multi-section precipitator.

In most installations, the configuration of the discharge electrodes will be such that DC and pulse voltages are applied in parallel to the individual electrodes of each section. In some cases, however, it may be advantageous to employ a folded transmission line as the discharge electrode. Such a folded transmission line is illustrated in FIG. 3 of the drawing and will be described later.

Figure 2:
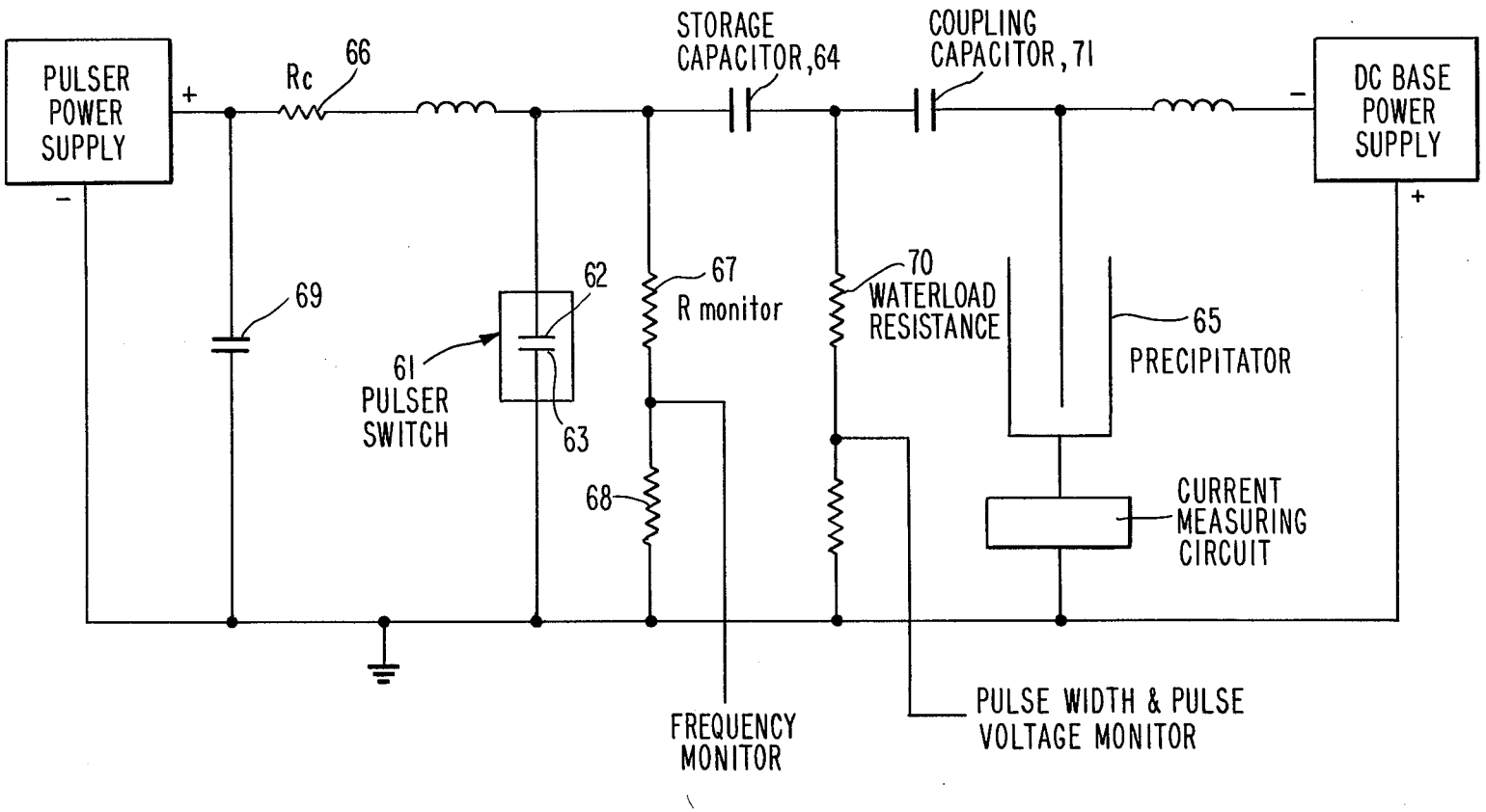
FIG. 2 is a schematic of the pulser circuit used in the test runs.

The essential feature of the pulser circuit shown in FIG. 2 is the pulsing switch 61 which is a physical gap between the high voltage electrode 62 and the ground electrode 63. For a pulse to be generated, the gap has to break down temporarily, dumping the energy from capacitor 64 into a water load resistance 70, resulting in a pulse voltage. The rate of rise of pulse and its decay are determined by R-C components 66–69. The charging resistor 66 as shown in the circuit determines the frequency of pulses. Separation of the gap determines the voltage at which the gap breaks down and, hence, the pulse voltage. Pulse width is determined by the water load resistance 70, storage capacitance 64, and the capacitance of precipitator load. The coupling capacitor 71 couples the base voltage from DC power supply with the pulse voltage produced by the above means.

To establish optimum operating conditions for the precipitator of FIG. 1, the following variable parameters were studied:

| | Variables | Range |
|---|---|---|
| (1) | Pulse width: | 250–1500 nanoseconds |
| (2) | Pulse voltage: | 30–80 KVp |
| (3) | Pulse frequency: | 80–1000 pps |
| (4) | Discharge electrode diameters with interelectrode spacing | a. 0.109" at 5¼"<br>b. 0.156" at 5¼"<br>c. 0.25" at 3½"<br>d. 0.50" at 1.75" |
| (5) | Gas temperature: | 160–320° F. |
| (6) | Particle size and concentration: | 5 μm mass median diameter, 3–4 grains/scfd |

-continued

| Variables | Range |
|---|---|
| (7) Gas Velocity: | 4–6 ft/sec |
| (8) Base voltage; | 10 KV–50 KV |
| (9) Particle Resistivity: | $10^{11}$–$10^{13}$ ohm-cm |

The observations made included the following:

(1) Pulse Width—Increasing the pulse width from 300 to 1000 nanoseconds was beneficial to precipitator performance. (Only the decay time was subject to variation. The rise time remained substantially steady at about 100 nanoseconds.)

(2) Pulse Voltage—Optimum performance was obtained with the pulser operating at the highest voltage possible for both the 0.25" and 0.109" discharge electrodes. Pulse voltages up to 80 KVp were used. The pulse voltage and width were monitored, as shown in FIG. 2.

(3) Pulse frequency—Increasing the pulse frequency from 100 pps to 200 pps did not have an appreciable effect on precipitator performance when both the pulse voltage and pulse width were kept constant. Increasing the pulse frequency to 1000 pps had a detrimental effect. The base voltage had to be reduced to low levels (about 10 kv) and current densities were difficult to control.

(4) Discharge Electrode Diameters and Interelectrode Spacing—The discharge electrodes were 0.109" diameter at 5¼" spacing and 0.25" diameter at 3½" spacing. Plate-to-plate spacing was 9".

(5) Gas Temperature—The dust was kept hot prior to injection into the air stream so as to prevent any agglomeration due to moisture. The high resistivity dust tests were at gas temperatures between 280 and 320 F.

(6) Base Voltage—The base voltage during pulse energization does not have to be at its highest prespark-ing level. There is an optimum base voltage depending on resistivity of flyash after which further increase results in deteriorating precipitator performance. For effective pulser operation, the base voltages should be below normal DC breakdown. In cases of very high resistivity, the base voltage may preferably be below the DC corona starting voltage.

(7) Current Densities—For optimum operating conditions, precipitator current densities varied between 5 and 10 milliamperes per thousand square feet of collecting surface. By using high pulse voltages and adjusting the pulse frequency and the base voltage, precipitator currents can be adjusted to operate below back-corona situations.

The Laboratory Tests

FIG. 1 shows the arrangement of the precipitator system used in the laboratory test program. Dust was fed to the system by a weigh feeder in order to accurately control dust loading. The dust was well dispersed in the inlet air stream by means of an ejector-distributor arrangement in the duct. Electric heaters were used to heat the inlet air to its desired operating temperature prior to entraining the dust. Downstream of the dust feed, a low-efficiency mechanical collector was used to remove larger particles and, therefore, present the precipitator with a relatively fine particle size.

In all of the runs, hydrated alumina was used as the high-resistivity dust. Its particle size distribution at the precipitator inlet was characterized by a mean diameter of 4.5 microns and a geometric standard deviation of 2.76. Particulate loading at the precipitator inlet was 3 grains/scfd. Resistivity of the dust was controlled by varying the operating temperature. For the tests reported in this paper the temperature levels were chosen to provide operation at very high resistivity with back-corona limitation, and moderately high resistivity with sparking limitation: at 300° F. the resistivity of the dust was $5\times10^{12}$ ohm-cm and at 200° F. the resistivity was $2.5\times10^{11}$ ohm-cm.

The precipitator itself was a single-duct precipitator consisting of three energized sections with total collecting plate area of 54 square feet. Each section was 4.5 feet long with an effective flow height of 2 feet. Collecting plate spacing was 9 inches, and discharge electrodes were 0.109 inch shrouded wires spaced 5¼ inches apart. The air velocity in the precipitator was 5 feet/sec for all runs. Thus the specific collection area (SCA) was 120 square feet/1000 acfm.

The precipitator was operated as a two stage precipitator, the inlet section being energized separately from the downstream two sections. During the pulse-energized runs, only the inlet section was pulsed, the downstream sections conventionally energized, serving as the collecting section. Base electrical energization of both sections was provided by 70 kVp full-wave rectified power supplies. Pulses were superimposed on the base voltage in the inlet section from the pulser system.

Prior to the test program outlet particulate concentrations from the precipitator were measured over a range of precipitation efficiencies under the operating conditions described above. These loadings were correlated with optical density as measured at the precipitator outlet using a Lear-Siegler RM4 optical transmissometer. During the test program transmissometer readings were taken and the correlation curve was used to determine the outlet loading during each run for precipitation efficiency calculation.

Table I presents the individual test results achieved during the test program. Results are grouped according to resistivity level and mode of operation (pulsed or conventional), not chronologically. Each of the runs was made at its optimum condition of energization; i.e. for the conventional runs, voltage was set at a value yielding maximum efficiency, and for the pulsed runs, the combination of base voltage, pulse voltage, pulse width, and frequency was set to yield best performance. Thus, the numbers reported in Table I are optimums so that comparison among modes can be made on the basis of best performance. All of the runs are shown to provide an indication of the reproducibility of results.

Table I.

| | Laboratory data for pulsed vs. conventional energization | | | | |
|---|---|---|---|---|---|
| Mode of Operation | Temp. (Degrees K) | Resistivity (ohm-cm) | Precipitation Efficiency (%) | W (m/sec) | $w_k$ (m/sec) |
| Conventional | 367 | $2.5\times10^{11}$ | 96.3 | .140 | .286 |
| | | | 98.0 | .166 | .375 |
| | | | 96.3 | .140 | .286 |
| | | | 96.3 | .140 | .286 |
| | | | 95.7 | .133 | .265 |

Table I.-continued

| Mode of Operation | Temp. (Degrees K) | Resistivity (ohm-cm) | Precipitation Efficiency (%) | W (m/sec) | $w_k$ (m/sec) |
|---|---|---|---|---|---|
| | | Laboratory data for pulsed vs. conventional energization | | | |
| | | | 95.3 | .129 | .253 |
| | | | 97.5 | .156 | .342 |
| | | | 97.0 | .148 | .315 |
| Pulsed | 367 | $2.5 \times 10^{11}$ | 98.0 | .166 | .375 |
| | | | 98.0 | .166 | .375 |
| | | | 98.3 | .172 | .401 |
| | | | 97.3 | .153 | .330 |
| | | | 99.7 | .246 | .707 |
| | | | 98.3 | .172 | .401 |
| | | | 98.0 | .166 | .375 |
| | | | 98.0 | .166 | .375 |
| Conventional | 422 | $5 \times 10^{12}$ | 82.7 | .0743 | .104 |
| | | | 82.7 | .0743 | .104 |
| | | | 80.3 | .0688 | .0920 |
| | | | 82.3 | .0733 | .102 |
| | | | 80.0 | .0681 | .0906 |
| | | | 82.7 | .0743 | .104 |
| Pulsed | 422 | $5 \times 10^{12}$ | 95.3 | .129 | .253 |
| | | | 96.0 | .136 | .275 |
| | | | 95.3 | .129 | .253 |
| | | | 94.3 | .121 | .228 |

All runs were conducted with inlet loading = 3 grain/scf and gas velocity = 5 feet/sec. Precipitator electrode geometries were conventional as described. Each test was run at optimum electrical energization.

For each of the cases, Table I shows collection efficiency, Deutsch migration velocity, w, and the modified migration velocity, $w_k$. The modified migration velocity is preferred for use in comparative evaluations of pulsed vs. unpulsed performance because its value in a given case is independent of the efficiency level. The modified efficiency equation is:

$$1-n=\exp\left[-(w_k A/V)^m\right] \quad (1)$$

where n—collection efficiency, fractional

A=collecting area, $m^2$

V=volumetric flow rate, $m^3$/sec $w_k$=modified migration velocity, m/sec m=exponent depending on inlet particle size distribution For the laboratory dust m—0.635.

Examination of Table I shows the expected trends in the data. Precipitator efficiencies for $5\times10^{12}$ ohm-cm resistivity level are lower than for the $2.5\times10^{11}$ level for both pulsed and conventional operation. However, at each resistivity level the pulsed operation is more efficient than conventional. In order to quantify the improvement in performance attributable to pulsed energization, a single value of $w_k$ was calculated for each mode of operation based on the average penetration (1-n) for that mode. A very good quantitative measure of improvement due to pulsing is then the ratio of these $w_k$ values at each resistivity level. This is because $w_k$ is a direct indicator of the level of precipitator energization. [3] Since the $w_k$ ratio represents an enhancement of precipitator energization it is termed the "enhancement factor", H.

Table II shows the effective $w_k$ for each operating mode and the enhancement factors at each resistivity level.

| Mode of Operation | Temp Degrees K | Resistivity (ohm-cm) | Precipitation Efficiency (%) | $w_k$ m/sec | Enhancement Factor |
|---|---|---|---|---|---|
| Conventional | | | 96.55 | .295 | |
| | 367 | $2.5 \times 10^{11}$ | | | 1.33 |
| Pulsed | | | 98.20 | .392 | |
| Conventional | | | 81.80 | .0993 | |
| | 422 | $5.\ 10^{12}$ | | | 2.53 |
| Pulsed | | | 95.22 | .251 | |

Because of the large number of individual runs involved in Table I and their good reproducibility in each mode of operation, it is felt that the values of the enhancement factor and their difference at the two resistivity levels have very significant meaning. The fact that the level of enhancement of $w_k$ increases as resistivity increases supports the previously described concept of the effect of pulsed energization. The poorer the conventional energization, the greater degree of improvement possible by pulsing. It should be noted, however, that although the enhancement factor increases with resistivity, the value of $w_k$ for both conventional and pulsed energization decreases. This shows that pulse-energized precipitation as well as conventional is subject to resistivity-caused limitations although the limitation to the pulsed performance is much less severe. This is reasonable based on theory, because, no matter how precipitator energization is achieved, dielectric breakdown of the dust layer will preclude further useful energization. With pulsed energization, however, greater and more uniform ion densities and higher effective field strengths exist when this limit is reached.

It was mentioned previously that only the inlet section of the laboratory precipitator was pulsed. This is consistent with the expectation that pulsed energization acts primarily to enhance particle charge. Thus, the laboratory setup represents a two-stage precipitator in which enhanced charging is accomplished in the inlet section and the downstream sections act primarily as collecting sections. Indeed it was found in a series of laboratory tests that pulsing more than the inlet section results in no significant performance improvement over pulsing only the inlet section. This, however, was not borne out in the full scale tests. See below.

Full Scale Results

Full-scale investigation of pulsed energization was conducted on a Research-Cottrell precipitator following a mechanical collector serving a pulverized coal fired boiler. Each of its two fields was equipped with separate pulsers. Each pulsed field contained a collecting plate area of 8200 $ft^2$. Plate spacing was 9 inches and discharge electrodes were 0.109 inch diameter wires spaced 5½ inches apart. The downstream unpulsed precipitator consisted of two fields each with collecting area of 10800 $ft^2$. The total collecting area of the precipitators was therefore 38,000 $ft^2$.

In order to characterize pulsed and conventional operation of the precipitator, a full test program was run at the site. During the test program, low-sulfur Eastern Bituminous coal was burned and the boiler was operated steadily at full load. The coal burned during the test program averaged about 1.1% sulfur with 18% ash content. Gas volume flow through the precipitator varied about 110,000 acfm. Data taken during the test program included in-situ resistivity measurements, particle size distributions, velocity traverses, stack opacity readings using a Lear Siegler transmissometer, precipitator outlet loadings, mechanical collector inlet loadings, and all electrical and boiler operating data. Coal and ash samples were collected during each run. Due to unacceptable flow patterns between the mechanical collector outlet and precipitator inlet it was not possible to measure directly the precipitator inlet loading and size distribution. However, by applying the mechanical collector performance curves to the measured mechanical collector inlet data it was possible to calculate the loading and particle size distribution to the precipitator for purposes of isolating precipitator performance. The size distribution of the ash to the inlet of the precipitator was found to be characterized by a mean diameter of 2.2 microns with a geometric standard deviation of 2.2.

Operation of the precipitator during the test program was typical of the moderately-high resistivity limitation characterized by heavy sparking at very low current levels resulting in poor energization. The in-situ resistivity measurements were compatible with this type of operation. They ranged from $1\times10^{11}$ to $9\times10^{11}$ ohm-cm, averaging about $5\times10^{11}$ ohm-cm.

All of the runs made during the test program were at optimum levels of operation for the mode being tested, i.e. both pulsed and unpulsed operations were set to yield maximum collection efficiency. Pulser variables in all runs were set at levels previously determined to be optimum.

Because it was possible to pulse each of the two inlet fields independently, four modes of operation were tested;

(1) All fields energized conventionally.
(2) Inlet field (A) pulsed, others conventional.
(3) Second field (B) pulsed, others conventional.
(4) Both inlet fields (A+B) pulsed, others conventional.

Table III presents data for runs made during the test program. The data are grouped by the mode of operation as described above, not chronologically. As with the laboratory data, precipitator efficiency, w, and $w_k$ are reported for each run. In addition, the average stack opacity and specific collection area for each run are reported; variations in SCA were due to fluctuations in gas volume. Finally the enhancement factor, H, is reported for each pulsed run. It is based on the average value of $w_k$ of 0.0805 for the unpulsed runs.

Table III.

Full-scale precipitator data for pulsed vs. conventional energization.

| Fields Pulsed | SCA ($ft^2$/1000 acfm) | Precipitator Efficiency (%) | Stack Opacity (%) | w (m/sec) | $w_k$ (m/sec) | H |
|---|---|---|---|---|---|---|
| None | 341 | 93.84 | 25.9 | .0415 | .0768 | — |
| None | 369 | 95.70 | 25.6 | .0433 | .0861 | — |
| None | 351 | 94.58 | 26.7 | .0422 | .0802 | — |
| A | 340 | 95.29 | 23.7 | .0457 | .0893 | 1.11 |
| A | 329 | 98.28 | 15.6 | .0627 | .145 | 1.80 |
| A | 339 | 96.05 | 21.5 | .0484 | .0978 | 1.21 |
| B | 349 | 95.35 | 22.8 | .0447 | .0876 | 1.09 |
| B | 371 | 95.56 | 20.8 | .0426 | .0842 | 1.05 |
| A + B | 337 | 16.3 | .0578 | .129 | 1.60 | |
| A+ B | 355 | 97.99 | 17.0 | .0559 | .127 | 1.58 |
| A + B | 371 | 98.24 | 16.3 | .0553 | .128 | 1.59 |
| A + B | 371 | 97.17 | 16.7 | .0488 | .105 | 1.30 |

For the particle size distribution determined at the inlet to the precipitator, the exponent, m, in the modified Deutsch efficiency equation is essentially the same as found for the laboratory dust, i.e. 0.625. The actual levels of w and $w_k$ are lower for the full-scale tests than for the corresponding laboratory tests. This is a normally expected difference.

Examination of the data in Table III shows consistent improvement in performance creditable to pulsed energization. The best improvement occurred in those runs in which both fields A and B were pulsed; the average enhancement factor for these four runs was 1.5. Pulsing either field A alone or B alone also improved performance in every run but not to the same extent as A and B together.

While the test program was being conducted it was very obvious, just by observing the stack, that the pulsed modes of operation were improving the precipitator performance. Plotting stack opacity vs. number of sections pulsed shows the benefits in going from zero to one to two pulsed fields in the precipitator. In fact, the plot appears to indicate that further significant benefits can be realized by pulsing additional fields.

The improvement in going from one to two pulsed fields is shown both in the enhancement factors in Table III and in the opacity reduction. This appears to contradict the laboratory results which showed essentially no additional improvement in pulsing more than one section. The explanation for this probably lies in the fact that the full scale operation is limited at a lower level of energization than the laboratory, for both pulsed and unpulsed operation. It is, therefore, reasonable to expect that a greater pulsed precipitator length is necessary in the full-scale application to accomodate the benefits of enhanced energization. In fact, it may further be expected that enhancement factors greater than those measured in the laboratory are possible in this situation because of the very low energization basis of conventional operation. This is indicated by the data in Table III.

Laboratory and full-scale tests have confirmed that the pulsed energization system significantly enhances precipitator performance for the collection of high resistivity dust. Laboratory data showed enhancement factors in the range of 1.33 to 2.53 for moderately high to very high resistivity; field data for a moderately high resistivity ash showed the ratio to be 1.5.

The improvement noted above may possibly be explained by the following hypothesis: The pulse voltage is essentially responsible for corona generation. Ions and electrons are generated during the rising portion of pulse voltage. The greater the peak voltage, greater will be the ions generated. Also, peak currents produced during the pulse will be orders of magnitude higher than the average current on the collecting plates. It is believed that extremely high ion densities are realized due to the pulse. These ions mutually repel each other during the pulseless period and expand towards the collecting plates under the field due to base voltage. It is felt that particle charging takes place during the time between pulses, in the presence of very high ion concentration and the field due to base voltage. It is also hypothized that the ionic space charge field further enhances the charging process. Also, the nature of corona during pulse energization is significantly different from that under conventional methods. Pulsed corona is very uniform and well distributed along discharge wires while the corona under conventional methods is spotty and randomly changes locations along the wire. Further, the radius of corona glow during pulsed energization is much larger than the conventional corona glow radius. Thus, pulsed corona is more likely to result in improved corona current distribution in the precipitators.

In summary, the extremely high instantaneous ion densities, high ionic space charge and the uniformity of corona current distribution will act together during pulse energization to result in particle charge magnitude superior to those found in conventional energization methods.

Conclusions (a) Effect of Pulse Voltage

It is concluded that increased pulse voltages result in higher field strengths and lead to better particle charging during each pulse. It is likely that the ion density per pulse is also higher. Thus, pulse voltages should be increased as much as possible for a precipitator configuration so as to maximize particle charging. Increasing the pulse voltage does not increase the average current significantly.

(b) Effect of Pulse Frequency

For a given pulse voltage, the ion density per second can be increased in almost linear proportion by increasing the frequency of the pulses. This leads to higher average current. Since average current on the plates is crucial for the onset of back-corona for high resistivity dusts, pulse frequency should be carefully controlled to keep the average current always under the critical current density required to trigger back-corona.

(c) Effect of Pulse Width

The pulse width is composed of pulse rise time and pulse decay time. It is believed that pulse rise time is responsible for ion and electron generation, while pulse decay time can provide high field strength conditions for particle charging. The shorter the pulse rise time, the higher can be the precipitator sparking voltage and hence higher particle charging. Increase in pulse decay time can also increase particle charging, in that particles can get charged under a longer period of high field strength. However, there is a limit for increasing the pulse decay time. Longer decay time approximates DC operation and hence lower sparking voltages will result. Increasing the rise time, will also lead to the same result and will not be effective for charging.

(d) Effect of Base Voltage

The base voltage should be operated below normal breakdown voltage (possibly below corona starting voltage) for high resistivity dust collection. It is known that DC corona is a non-uniform corona discharge and, hence, for high resistivity application back-corona could be triggered by the combination of DC corona and pulses. It is believed that the base voltage will perform the particle collection function and help in rapid expansion of the pulse generated ion-cloud to the collection plate, leading to a uniform current distribution.

(e) Optimizing Precipitator Performance

On the basis of the foregoing, a precipitator may be optimized by using suitable discharge and collecting electrode configurations that will increase the DC corona starting voltage so as to operate at higher collecting fields. The precipitator should be operated with the base voltage near or below the corona starting voltage. The pulse voltage should be increased to the highest practically feasible value. Pulse width and frequency should then be adjusted for a given precipitator to operate at its optimum performance.

For particles of moderate resistivity, it will be possible to make use of the pulsed energization concept by increasing the base voltage to values higher than its corona-starting voltage since back-corona will not be a problem. The pulse voltage could then be adjusted, along with the pulse frequency and pulse width, to optimize the precipitator performance.

It was previously mentioned that in most installations where precipitator has multiple ducts, the discharge electrodes will be connected in parallel, but that in some cases a folded transmission line may be used as the discharge electrodes. Such a folded transmission line is illustrated in FIGS. 3.

In FIG. 3, four collecting plates 21–24 are seen forming a lane for gas flow between each pair of collecting plates. The four plates 21–24 seen in FIG. 3 are merely illustrative of a larger number of plates and a larger number of lanes which might be employed. Suspended in each lane between the collecting plates 21–24 are discharge wire electrodes 32–35. The gas flow is in the direction indicated by the arrow in FIG. 3. Thus, the gas flow is parallel to the sidewalls of the collecting plates and transverse to the discharge electrodes 32–35. Each of the corresponding discharge wire electrodes in each lane are tied together, either at the bottom or at the top, to form a continuous folded transmission line, as illustrated in FIG. 3. A pulse input applied at 36 will be transmitted to all the discharge electrodes as in a folded transmission line. The advantage of the use of a transmission line for the transfer of pulse voltage is that the pulse voltage may be less affected by precipitator capacitance and hence less affected by the size of the precipitator. Thus, it may be easier to control the wave shape of the pulse.

What is claimed is:

1. A method of operating a multi-section precipitator for the collection of high resistivity dust, said precipitator having at least three sections, each section having discharge electrodes comprised of wires having diameters of from 0.109 to 0.250 inches, said wire electrodes being spaced from 3½ to 5½ inches apart, each section having collecting plates spaced 9 inches apart, the spacing from each electrode to a collecting plate being 4.5 inches, the collecting plates of each section having a total area of at least 8200 square feet, said method comprising the steps of:

a. applying a DC base voltage in the 30–50 kilovolts range between the discharge electrodes and the collection plates;

b. setting said DC base voltage to have a value near to but just below the corona starting voltage and such that the resultant electric field is within the range 3.0–7.5 kilovolts per inch;

c. applying in parallel, to the discharge electrodes of at least one but not more than the first two sections, short pulse voltages in the 50–80 kilovolts range, said pulses being of the same polarity as said DC base voltage, said pulses being applied at a pulse repetition rate in the range of 80–200 pulses per second;

d. setting said pulse voltages plus DC base voltage to have a peak above the normal DC breakdown level;

e. setting said pulse voltages to have a fast rise time not greater than 200 nanoseconds and a short decay time, said pulse having a width of from 250 to 1500 nanoseconds, to avoid excessive sparking;

f. adjusting said DC base voltage in coordination with adjustment of said applied voltage pulses to vary the charging and collecting fields independently of each other and to maintain an average current through the collected dust layer just below or at that value which would cause electrical breakdown of the dust layer.

2. The method according to claim 1 wherein the first two sections of the multi-section precipitator are pulsed by separate pulsers.

3. The method according to claim 1 wherein the pulse voltage rise time is of the order of 100 nanoseconds.

4. The method according to claim 1 wherein the average precipitator current through the collected dust layer is between 5 and 10 milliamperes per thousand square feet of collecting surface.

* * * * *

UNITED STATES PATENT AND TRADEMARK OFFICE

CERTIFICATE OF CORRECTION

PATENT NO. : 4,209,306

DATED : June 24, 1980

INVENTOR(S) : Paul L. Feldman et al.

It is certified that error appears in the above—identified patent and that said Letters Patent is hereby corrected as shown below:

Column 8, Table III should appear as shown on the attached sheet.

Signed and Sealed this

*Eleventh* Day of *November 1980*

[SEAL]

*Attest:*

SIDNEY A. DIAMOND

*Attesting Officer*

*Commissioner of Patents and Trademarks*

Table III. Full-scale precipitator data for pulsed vs. conventional energization.

| Fields Pulsed | SCA ($ft^2$/1000 acfm) | Precipitator Efficiency (%) | Stack Opacity (%) | w (m/sec) | $w_k$ (m/sec) | Π |
|---|---|---|---|---|---|---|
| None | 341 | 93.84 | 25.9 | .0415 | .0768 | -- |
| None | 369 | 95.70 | 25.6 | .0433 | .0861 | -- |
| None | 351 | 94.58 | 26.7 | .0422 | .0802 | -- |
| A | 340 | 95.29 | 23.7 | .0457 | .0893 | 1.11 |
| A | 329 | 98.28 | 15.6 | .0627 | .145 | 1.80 |
| A | 339 | 96.05 | 21.5 | .0484 | .0978 | 1.21 |
| B | 349 | 95.35 | 22.8 | .0447 | .0876 | 1.09 |
| B | 371 | 95.56 | 20.8 | .0426 | .0842 | 1.05 |
| A+B | 337 | 97.84 | 16.3 | .0578 | .129 | 1.60 |
| A+B | 355 | 97.99 | 17.0 | .0559 | .127 | 1.58 |
| A+B | 371 | 98.24 | 16.3 | .0553 | .128 | 1.59 |
| A+B | 371 | 97.17 | 16.7 | .0488 | .105 | 1.30 |